US005195949A

United States Patent [19]

Burton et al.

[11] Patent Number: 5,195,949

[45] Date of Patent: Mar. 23, 1993

[54] TRACTION DEVICE

[75] Inventors: Charles V. Burton, Excelsior; Gregory K. Peterson, North Oaks; Casey L. Carlson, Edina; Jeffrey A. Weber; William E. Stumpf, both of Minneapolis, all of Minn.

[73] Assignee: Spinal Designs International, Inc., Minneapolis, Minn.

[21] Appl. No.: 918,778

[22] Filed: Jul. 21, 1992

Related U.S. Application Data

[63] Continuation of Ser. No. 789,616, Nov. 8, 1991, abandoned, which is a continuation of Ser. No. 473,350, Feb. 1, 1990, abandoned.

[51] Int. Cl.[5] ..... A61H 1/02

[52] U.S. Cl. ..... 602/19; 602/1

[58] Field of Search ..... 602/15, 19, 1

[56] References Cited

U.S. PATENT DOCUMENTS

| | | | |
|---|---|---|---|
| 1,356,365 | 10/1920 | Hosmer . | |
| 2,984,238 | 5/1961 | Axtell et al. | 128/75 |
| 3,103,357 | 9/1963 | Berne | 272/79 |
| 3,167,068 | 1/1965 | Carr | 128/75 |
| 3,353,532 | 11/1967 | Ellis | 128/75 |
| 4,030,489 | 6/1977 | Buckner | 128/75 |
| 4,205,665 | 6/1980 | Burton | 128/68 |
| 4,269,179 | 5/1981 | Burton et al. | 128/75 |
| 4,396,012 | 8/1983 | Cobiski | 128/75 |
| 4,422,452 | 12/1983 | Burton | 128/75 |
| 4,515,152 | 5/1985 | Tweeter | 128/75 |
| 4,569,340 | 2/1986 | Burton | 128/75 |
| 4,583,533 | 4/1986 | Goodley et al. | 128/75 |
| 4,603,689 | 8/1986 | Horner | 128/75 |
| 4,617,919 | 10/1986 | Suhre | 128/78 |
| 4,688,557 | 8/1987 | Bradstreet | 128/71 |
| 4,715,362 | 12/1987 | Scott | 128/75 |
| 4,725,055 | 2/1988 | Skowronski | 272/144 X |
| 4,746,116 | 5/1988 | Inada | 272/144 |
| 4,854,305 | 8/1989 | Bremer | 128/75 |
| 4,881,528 | 11/1989 | Scott | 128/78 X |
| 5,033,459 | 7/1991 | Burton | 128/71 |

FOREIGN PATENT DOCUMENTS

| | | | |
|---|---|---|---|
| 980199 | 12/1975 | Canada | 128/75 |
| 2363390 | 6/1975 | Fed. Rep. of Germany . | |
| 3104832 | 1/1983 | Fed. Rep. of Germany . | |
| 3420858 | 12/1985 | Fed. Rep. of Germany . | |
| 1371332 | 7/1963 | France . | |
| 8910732 | 11/1989 | PCT Int'l Appl. | 128/75 |
| 797664 | 1/1981 | U.S.S.R. . | |
| 0812280 | 3/1981 | U.S.S.R. | 128/75 |

OTHER PUBLICATIONS

International Publication No. WO 80/01540.

*Primary Examiner*—V. Millin
*Assistant Examiner*—J. Doyle
*Attorney, Agent, or Firm*—Merchant, Gould, Smith, Edell, Welter & Schmidt

[57] ABSTRACT

A traction seating device 10 includes a base support 11 on which first and second arm assemblies 15 and 16 are mounted. Preferably, the arm assemblies 15 and 16 are pivotally mounted and torso embracing members 29 and 30 are cooperatively connected thereto. A seat 43 depends from the arm assemblies 15 and 16 and as a person using the device 10 sits on the seat 43, the arms assemblies 15 and 16 are brought inward to move the device from an unengaged to an engaged position wherein the stress may be transferred from the lumbar spine to the rib cage of the person using the device.

12 Claims, 4 Drawing Sheets

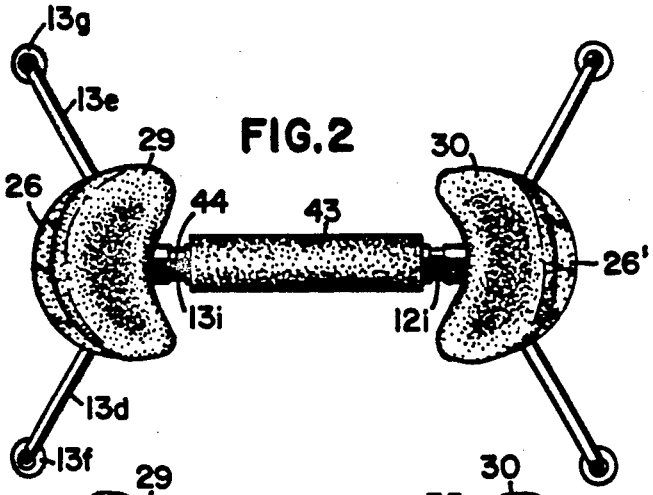
FIG.2
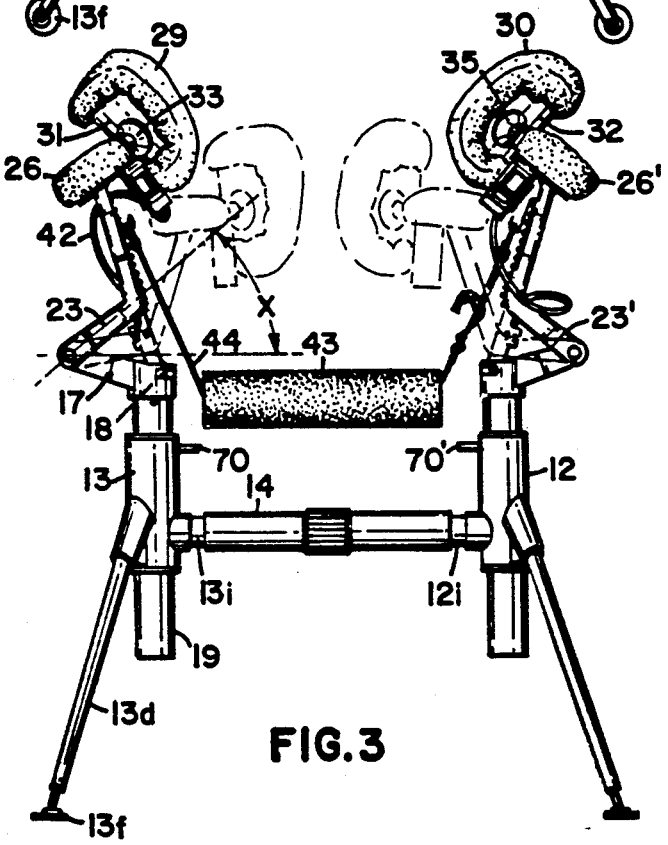
FIG.3
FIG.5
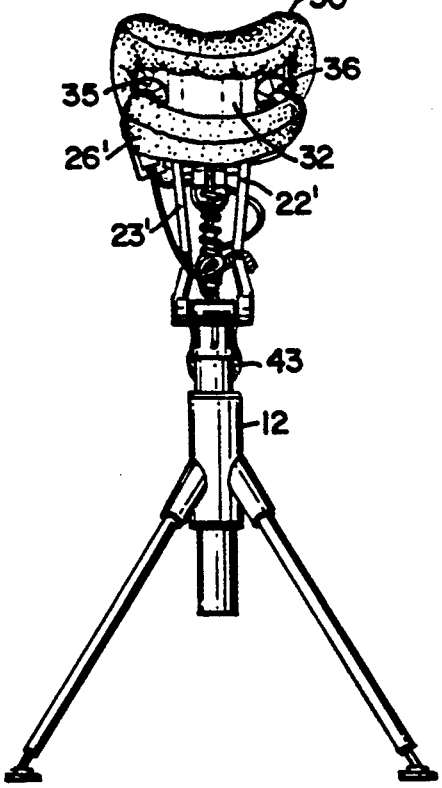
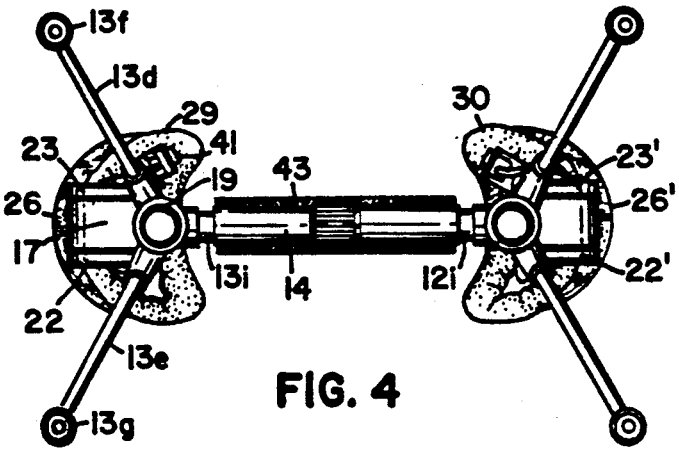
FIG. 4

TRACTION DEVICE

This is a continuation of application Ser. No. 07/789,616, filed Nov. 8, 1991, now abandoned, which is a continuation of application Ser. No. 07/473,350, filed Feb. 1, 1990, which was abandoned upon the filing hereof.

FIELD OF THE INVENTION

This invention refers generally to a apparatus for transferring weight stress and loading from the lumbar spine to the rib cage of an individual to thereby obtain benefits associated with unloading the spine. More specifically, this invention relates to utilizing the force of gravity to unload the spine and promote normal nutrition and healing of the lumbar spine and its components. This device utilizes a support which embraces the torso. The device further includes an adjustable base support, whereby the apparatus is portable. The device provides an apparatus for exercise relative to the abdomen and lower extremity, especially the disc tissue of the lumbar spine. The art by which this invention was developed reflects more than a decade of medical clinical research and testing.

BACKGROUND OF THE INVENTION

Back pain is a common and significant mallady afflicting large numbers of people and virtually every country of the world. The wide spread nature of the problem has been highlighted in numerous articles printed in both medical and news periodicals. Illustrative are articles entitled Bare-bones Facts About Your Aching Back from the December, 1980 issue of *Readers Digest* and the cover story from the Jul. 14, 1980 issue of *Time* magazine.

Axial traction has been shown to be effective in treating certain types of low back ailments, in preventing back ailments and in producing and sustaining low back health. Such traction has been found to be an effective means of realigning improperly aligned or displaced vertebral elements as well as their associated invertebral discs and soft tissues. Such traction when used periodically for sustained periods has also been shown to reduce herniated contained intervertebral discs. Further, such traction has also been shown (in muscle and ligament injury or insult) to reduce spasm and inflammation, enhance blood flow and to promote optimal healing. Certain circumstances have, however, long presented obstacles to the effective application of controlled traction to the lumbar area. These circumstances include the significant amount of force which must be applied, the lack of a location at which the axially directed force can be applied, and the position of the person during which the axial force is being applied.

In 1971, Charles Burton, M.D. provided for the construction of an apparatus to support a person, such person having one of a number of conditions such as a protruded lumbar disc, in a vertical position wherein the torso of the person was suspended from above by a chest harness and vest encircling the rib cage. As a result of related research and experience, it has been demonstrated scientifically and conclusively that the rib cage can serve as an optimum site of fixation and does serve well this purpose. In order for the overhead harness vest to function most effectively, it was observed that it should, at its lower end, be tightened beneath the rib cage so that, as axial force is applied by the body's weight to the harness, the rib cage will not slide out of the harness of vest.

After continued research, an improved gravity traction vest was developed. Prior to this time, the tightening of a lower most belt of the gravity vest was accomplished exclusively by providing a belt having a sufficient number of locking points whereby the belt could be tightened so that it was within the perimeter of the rib cage regardless of the size of the person being treated. The new improved gravity traction vest (shown in U.S. Pat. No. 4,422,452) provided means whereby axial fixation could be efficiently accomplished, yet wherein the treatment is not rendered uncomfortable.

While the improved second generation gravity traction vest provided improvement over the original gravity traction vest, there remained a number of problems associated with its use. These problems included the need to tighten a number of cinctures to secure the vest to the person, the rough surfaces of the cinctures being felt through the vest by the person. While there was an improved locking of the vest to the person due to a cushion insert, it was desirable to provide for still more positive locking. The need to provide improved comfort to the person has always been a goal which each new generation of product has tried to accomplish. The goal was to provide a vest which allowed the person to experience gravity traction without causing unnecessary discomfort. While there has been improvement in this area, there has been the need for still more improvement.

It is these problems in the prior art that a third generation gravity traction vest was developed. It provides for a torso surrounding member being constructed of a rigid material, a simple and effective means for securing the vest to the person and a flanged under portion that protrudes inwardly toward the person for engagement below both the lowest rib and the inverted U-shaped area of the rib cage. U.S. Pat. No. 4,569,340 was issued on Feb. 11, 1986 on such a vest.

While such vests have been utilized for many persons and have proved quite successful, all of the vests to date have required overhead support of the vest. This is a drawback in that such devices are large and cumbersome and are best utilized in a hospital or clinic setting.

Alternative supports for applying gravity traction have been suggested, but none has yet found wide acceptance. For example, U.S. Pat. No. 3,353,532 issued to L. C. Ellis describes a traction apparatus wherein support is provided to a patient by side members and does not utilize a vest which encircles the patient's body. However, such a device has not proven to the practical in that there is no means for force to be applied gradually to the spine. Still further, the side members appear to work by a simple compression from just underneath the armpits of the patient to just above the waist of the patient. This is very uncomfortable to many users.

In a somewhat similar fashion, U.S. Pat. No. 4,583,533 issued to Paul H. Goodley et al describes an orthopedic lumbar apparatus for treating back ailments by use of two corselets which are connected to surround the torso and which are attached to struts that may be engaged when the person is either standing or sitting.

The successful prior art devices have tended to be vests and have accordingly encircled the torso of the person using the device. Although the vests have been employed successfully, one of the inherent drawbacks of a vest is that a large portion of the torso is encircled and breathing can be somewhat restricted as the tightly cinched vest covers the rib cage. Further, because the torso is encircled, there is a greater heat build up for the person. Further, because of the total device design, the person is somewhat restricted from accomplishing movement of the body such that beneficial tissue exercise can not be accomplished. In addition, the overall devices of previous apparatus have tended to be large, relatively expensive and not easily transportable.

Dr. Charles Burton, one of the applicants of the present application, has two pending applications, U.S. Ser. Nos. 301,172 and 301,176, both filed Jan. 24, 1989. These applications disclose devices for transferring stress to the lumbar spine to a rib cage of a person and do not use overhead support. Further, the device disclosed in Ser. No. 301,172 includes both a seat member and a support member. The person assumes a seating position on the seat member and is also supported thereby. The amount of support provided the person by the seat member and the support member may be varied, thereby transferring varying amounts of stress from the lumbar spine to the rib cage of the person utilizing the device. While both of the devices disclosed in the two above-noted applications are improvements over the prior art, applicants have found several significant areas to improve the traction devices.

SUMMARY OF THE INVENTION

The present invention is a device for transferring stress from a lumbar spine to a rib cage of a person without the use of an overhead harness or vest. The device includes a torso embracing member for at least partially surrounding the torso proximate the waistline and for engaging and supporting a person below the rib cage. The member has a first section and a second section. A first pivot arm has a first end operatively connected to the first section and a second pivot arm has a first end operatively connected to the second section. A base support is configured to pivotally mount the first and second pivot arms. A seat member is operatively connected to the device, wherein the pivot arms move between an unengaged position to an engaged position. There is also provided a means for locking the pivot arms in a fixed position.

In another embodiment, the device includes a torso embracing member for engaging and supporting a person below the rib cage. The member has first and second sections and the sections each have a generally horizontal longitudinal protrusion. A first moveable arm has a first end operatively connected to the first section at a first location and second moveable arm has a first end operatively connected to the second section at a second location. The base support is configured to moveably mount the first and second moveable arms. A seat member is operatively connected to the device, wherein the moveable arms move between an unengaged position to an engaged position. There is further provided a means for rotating the sections about a horizontal axis wherein the sections rotate to cause the protrusions to move further under the rib cage. In a preferred embodiment, the moveable arms are pivotal. Further, in a preferred embodiment, when in an engaged position, a line from a first location to the first pivotal point forms an angle of from about 30° to 50° to the horizontal and preferably from about 35° to 45°.

In another embodiment, the device includes a torso embracing member for at least partially surrounding the torso proximate the waistline, the member having first and second sections. A first moveable, and preferably pivotable, arm having a first end operatively connected to the first section and a second moveable, preferably pivotable, arm having a first end operatively connected to the second section. A base support is configured to moveably mount the first and second moveable arms and a seat member is operatively connected to the moveable arms, wherein the person sitting on the seat member assists in moving the moveable arms from the unengaged to an engaged position. The sections are preferably covered by a suitable upholstery or fabric such as a polypropylene fiber blend and still further, the sections preferably have a back portion which are positioned at an angle from the vertical of from about 10° to 15°.

BRIEF DESCRIPTION OF THE DRAWINGS

FIG. 2 is a top plan view of the embodiment shown in FIG. 1;

FIG. 3 is a front elevational view of the embodiment shown in FIG. 1 showing the device in an unengaged position and an engaged position in phantom lines;

FIG. 4 is a bottom plan view of the embodiment shown in FIG. 1;

FIG. 5 is a right side view of the embodiment shown in FIG. 1;

DETAILED DESCRIPTION OF THE PREFERRED EMBODIMENT

Figure 1:
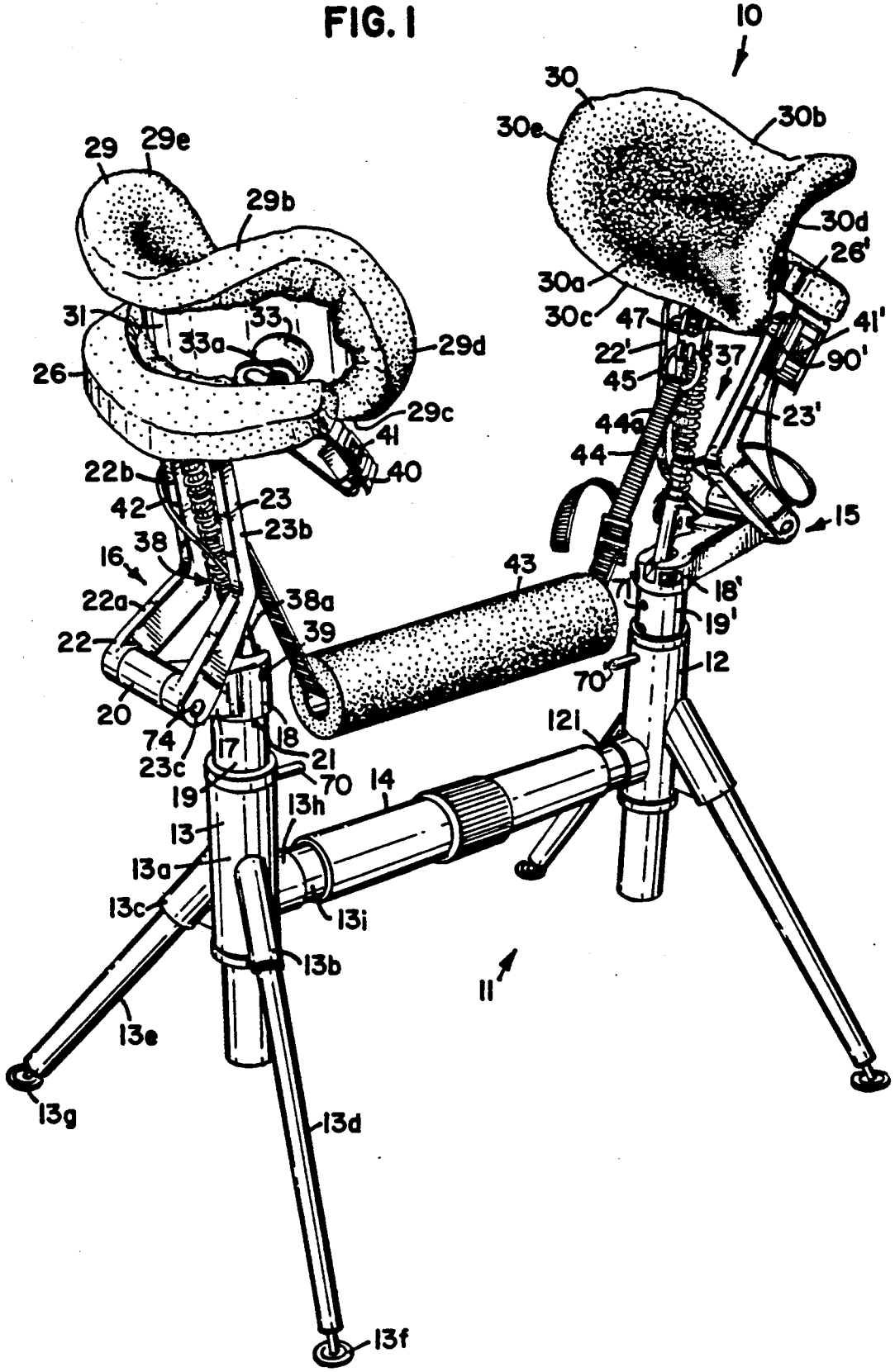
FIG. 1 is a perspective view showing one embodiment of the present invention.
Figure 6:
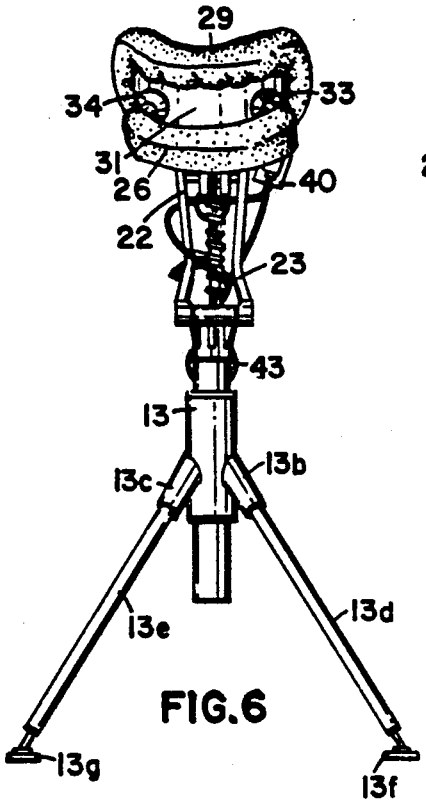
FIG. 6 is a left side view of the embodiment shown in FIG. 1.

Referring to the drawings, wherein like numerals represent like parts throughout the several views, there is generally disclosed at 10 a traction seating device. The device 10 includes a base support generally designated at 11. The base support includes a first upright member 12 and a second upright member 13. The uprights 12 and 13 are mirror images of each other and accordingly only one of the uprights will be disclosed in detailed. The second upright 13 includes a cylinder **13*a* which has a longitudinal bore. The cylinder 13*a* has two generally outwardly and downwardly depending leg supports 13*b* and 13*c*. The leg supports 13*b* and 13*c* are configured to receive leg 13*c* and 13*e* respectively. Pads 13*g* and 13*f* are operatively connected to the legs 13*c* and 13*e*. Casters may also be utilized. The second upright member 13 also has a cross member support 13*h*. A cross member 13*i* is configured to be supported by the cross member support 13*h*. A connector 14 is configured to be carried on the outside of the cross member 13*i* and similarly on the cross member 12*i* of the first upright support member 12. Both the cross members 12*i*** and 13*i* are in threaded engagement with the inside of the connector 14 such that the connector 14 is able to be rotated on the cross members 12*i* and 13*i*, thereby increasing or decreasing the distance between the first upright member 12 and the second upright member 13. It is understood that other suitable constructions of a base support 11 may be incorporated in the present invention.

Figure 8:
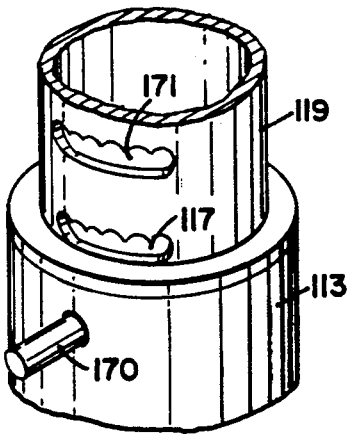
FIG. 8 is another embodiment of a portion of the adjustable upright for the device of the present invention.

A first pivot arm assembly designated generally as 15 is operatively connected to the first upright member 12 and a second pivot arm assembly designated generally as 16 is operatively connected to the second upright member 13. The assemblies 15 and 16 are similar and accordingly only one of the assemblies will be described in detail. The second pivot arm 16 is operatively connected to a base member 17 which has a cap 18 at one end. The cap 18 is sized and configured to fit over the top of a cylindrical extension member 19. The cylindrical extension member 19 is sized and configured to slide inside the longitudinal bore of the cylinder 13*a* of the second upright member 13. The cap 18 may be suitably secured to the extension member 19 by any suitable means. One means utilized by the present invention is to have the cap 18 pinned to the extension member 19. This is done by simply having the cap 18 formed with an internal cylinder which is sized to slide inside of the bore of the extension member 19. A pin 21 is then pressed into a hole in the member 19 and into a hole in the inner cylinder of the cap 18. The second end of the base member 17 has formed therein an elongated cylindrical portion 20 having a longitudinal bore formed therein. The extension member 19, has a plurality of holes, similar to holes 71' in extension member 19'. The upright member 13 has a hole through which a pin 70 may be inserted into one of the holes 71 as the extension member 19 is slid up and down. An alternative embodiment is shown in FIG. 8 wherein extension member 19 has a plurality of elongated holes 171. The holes 171 have a plurality of lobes which are sized to match the pin 170. This allows the extension member 119 to be rotated and locked in position in a variety of angles by pin 170. As shown in FIG. 8, there are six lobes in the hole 171. Accordingly, six different angles may be obtained. It is understood that other suitable arrangements may also be used to provide for rotating the extension member 119 through a variety of angles.

Figure 11:
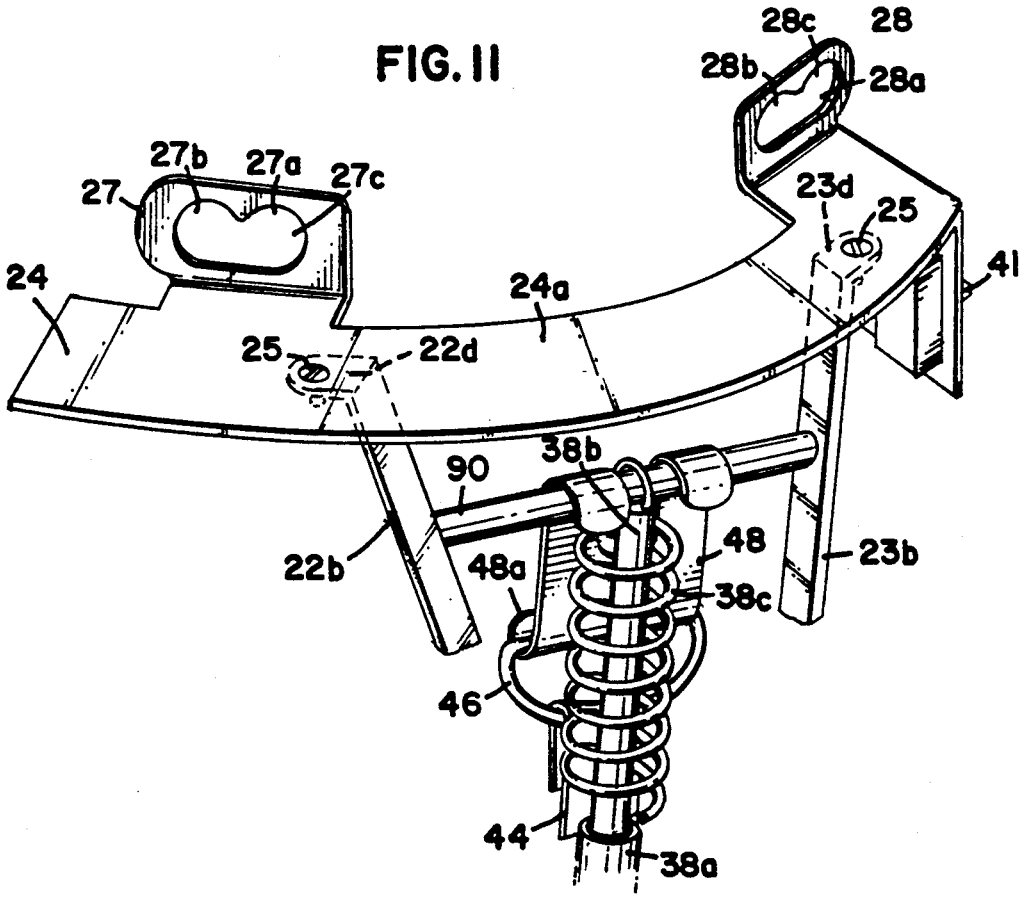
FIG. 11 is a perspective view of a mounting bracket used in the embodiment shown in FIG. 1.

The pivot arm assembly 16 also includes a first arm 22 and a second arm 23. The first arm has a first portion 22*a* integrally formed with a second portion 22*b* and the second arm has a first portion 23*a* and a second portion 23*b* formed as an integral part thereof. The portions 22*a* and 22*b* are designed to form an angle of approximately 150°. It is understood that other suitable angles may also be utilized. The first arm 22 has a bore 22*c* through its first end and similarly the second arm 23 has a bore 23*c* through its first end. A pin 74 is inserted through the bore 22*c*, the bore of the cylindrical portion 20 and the bore 23*c*. thereby making a pivotal connection. As best seen in FIG. 11, the second portions 22*b* and 23*b* respectively have flanges 22*d* and 22*e*, each with an aperture formed therein. The flanges 22*d* and 23*c* are utilized to operatively connect the arms 22 and 23 to a mounting bracket 24. Screws 25 or other suitable fastening means may be utilized to connect 30 the flanges 22*d* and 23*c* to the bracket 24. A cross support 90 (see FIG. 11) is operatively connected between portions 22*b* and 23*b*, slightly below the flanges 22*d* and 23*d*.

The bracket 24 (see FIG. 11) has a generally flat top surface 24*a* in a partial circular configuration. On the top surface 24*a* is mounted an arm rest 26 (see FIG. 1) by suitable means such as an epoxy or glue. Two generally upwardly extending flanges 27 and 28 are operatively connected to, and preferably integral with, the mounting bracket 24. Flange 27 has an opening 27*a* which has a first lobe 27*b* and a second lobe 27*c*. Similarly, the flange 28 has an opening 28*a* having a first lobe 28*b* and a second lobe 28*c*.

Two arcuate torso embracing members 29 and 39 are utilized. The members 29 and 30 are mirror images of one another and accordingly only one of these members will be described in detail. As previously indicated, the member 29 is arcuate in shape and is configured to engage the person utilizing the device proximate the waistline and a protrusion 30*a* is formed proximate the center of the member 29 and extends longitudinally. As best seen in FIG. 1, member 30 has top 30*b*, bottom 30*c*, front 30*d*, and rear portions 30*e*. Similarly the member 29 has top 29*b*, bottom 29*c*, front 29*d* and rear 29*e* portions. The protrusion 30*a* is designed to fit immediately under the rib cage and ultimately provide support under the rib cage of the person utilizing the device 10. The protrusion 30*a* may be formed from a pneumatic bag, a formable gel bag, or for easier maintenance, a suitable substitute. The member 29 is generally of a formed polymer material (such as ⅛" ABS grade shell) with an upholstered covering (such as a non-biased polypropylene fiber) with foam inner layer (such as ½" polyurethane foam) and has a flexibility which allows it to support and conform to the person's torso. The members 29 and 30 are operatively connected to a semi-rigid backing 31 and 32, respectively. The members 29 and 30, in combination, partially surround the wearer proximate the waistline. The top portion is flexible to support the person. The front and rear portions are flexible to allow diaphragm and abdominal breathing. The above-described construction provides for a semi-rigid member capable of supporting the wearer, but at the same time flexible. The top 30*b* and bottom 30*c* are flexible which allow for comfort of the user as well as support. The flexibility of the front 30*d* and rear 30*e* portions allow for increased flexibility which allows easier diaphragm and/or abdominal breathing.

Figure 9:
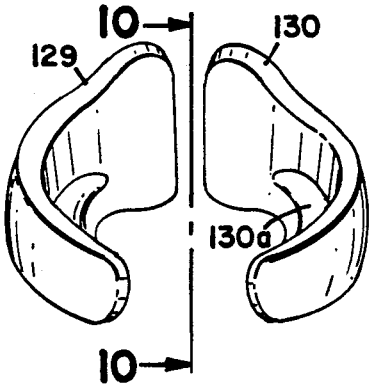
FIG. 9 is a perspective view of another embodiment of the torso embracing member.
Figure 10:
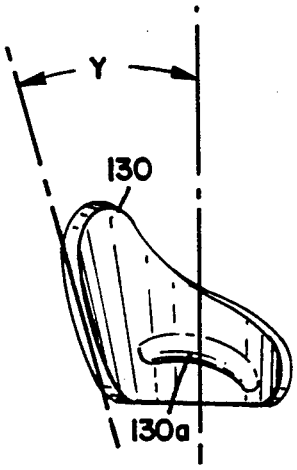
FIG. 10 is a side elevational view of the torso embracing member of FIG. 9.

Another embodiment of the torso embracing members is shown in FIGS. 9 and 10. Torso embracing members 129 and 130 are similar to the previously described members 29 and 30 with the additional feature of the back sections of the members 129 and 130 are larger at their back portions. The back section is slightly taller to act more as a backrest. The back sections are also wider so that the back portion extends more toward the center line of the device 10. By so doing, when the device 10 is in an engaged position, the back edges of members 129 and 130 come close to touching so that a more complete backrest is defined, thereby more fully surrounding the torso. It is also possible for the front sections to be extended so that, when engaged, they would extend more to the center line of the device 10 and thereby still more fully surround the torso. As shown in FIG. 10, the members 129 and 130 are constructed such that a person using the device would be generally tipped at the angle shown in FIG. 10, or approximately 10 to 15 degrees.

First and second, generally conical, elastomeric grommets 33 and 34 are operatively connected, by suitable means to the backing 31. The grommets have a threaded shank which is screwed into grommet mounting holes in the backing 31. The metal shank is attached to a metal insert which is cast into the grommet during construction. The metal insert is utilized to provide a means of attachment. The grommet (an elastomer, rubber compound, such as polyurethane) provides a multi-degree of freedom flexible hinge. Similar grommets 35 and 36 are operatively connected to the backing 32. The grommets 33–36 each have a cylindrical end, such as 33*a*, which is sized slightly larger than the opening of one of the lobes 28*b* or 28*c*. The assemble the member 29 to the mounting bracket 24, it is simply necessary to compress the end 33*a* into one of the lobes and upon expansion, the elastomeric grommet 33 will securely hold the member 29 to the mounting bracket 24. Two lobes are present in each one of the flanges to allow for different sized member 29 to be utilized in the same device 10. The grommets 33–36 are constructed from a suitable material such as a metal reinforced elastomer. The grommets are positioned to allow an upward support to the rib cage when engaged with the person's body. The grommets 33–36 are positioned below the centerline of the members 29 and 30. This allows upward support of the rib cage without significant side pressure. The grommets 33–36 are preferably located not only below the centerline of the members 29 and 30, but also at a level generally proximate the protrusions 29*a* and 30*a*.

A first linear locking device 37 is operatively connected between the cap 18' of the first arm assembly 15 and the cross support piece 90' between the first arm 22' and the second arm 23'. A second linear locking device 38 is operatively connected between the cap 18 and the cross support piece 90 of the second arm assembly 16. Again, the second linear locking device 38 is similar to the first linear locking device 37 and accordingly only one will be described in detail. The locks 37 and 38 are spring clutch devices which provides infinite positioning within the travel range of the device. Such devices are presently available from P. L. Porter Company, Woodland Hills, Calif., Model MM65-1150. The lock 38 has a first section (cylinder) 38*a* rotatably bolted in the cap 18 by means of a bolt 39. The cap 18 has an opening in which the first section 38*a* is inserted and bolt 39 is then inserted through the cap 18 and into an aperture in the first section 38*a* and then out the other side of the cap 18 to securely fix the first section 38*a* to the cap 18. However, the bolt 39 does allow for rotation of the first section 38*a* about the bolt 39. A second section (piston rod) 38*b* is operatively connected to the cross member 90. The second section 38*b* is a piston which slides within the first section 38*a*. The device 38 also includes a spring 38*c*. A remote control 40 has a switch 41 which, through wire 42, can lock the locking device 38 is any position as the piston 38*b* moves in the first section 38*a*. The same control can be accomplished with electromechanical and hydraulic devices.

A seat 43 has a longitudinal bore through which an adjustable strap 44 is positioned. A first end 44*a* of the strap 44 is cooperatively connected to a first ring 45 and a second end 44*b* is cooperatively connected to a second ring 46. A clip 47 has a looped end which fits across support 90' and similarly clip 48 has a looped end which fits over the cross support 90. The clip 48 has an upwardly extending flange 48*a* at its other end on to which ring 46 is placed. Similarly, ring 45 is placed on a corresponding upwardly extending flange on the clip 47. A seat utilizing a flexible sling construction and an upwardly or downwardly adjustment is also contemplated.

Figure 7:
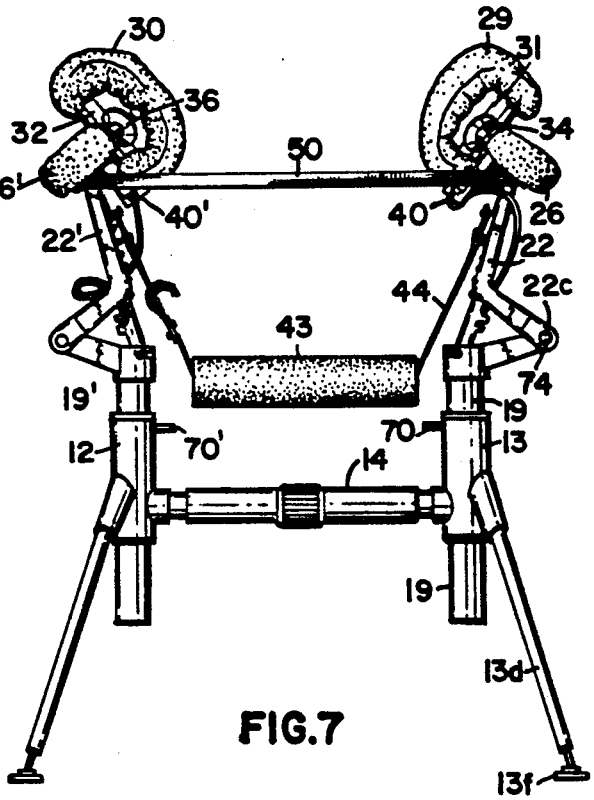
FIG. 7 is a rear view of the embodiment shown in FIG. 1 with the additional feature of a back safety strap.

As shown in FIG. 7, a safety back strap 50 may be secured underneath each of the armrests 26 by any suitable manner. The safety strap 50 would extend across the back of the device 10, and may serve as a back rest for the person.

In operation, the person using the device 10 positions himself over the seat 43 so that he is on the side of the seat 43 which enables him to operate the remote controls 40. With his right hand on switch 41 and his left hand on switch 41', the person bends his knees and begins to sit on seat 43. At the same time, his arms are resting on armrests 26 and 26' such that he may push inward and pivot the torso embracing members 29 and 30 into engagement with his torso, proximate the waistline and at least partially surrounding the torso. During this time, the switches 41 and 41' are in an unlocked position to allow the locking devices 37 and 38 to move freely. It is not necessary that the person using the device 10 have enough strength to firmly snug the members 29 and 30 around his body. By bending his knees and sitting on the seat 43, this motion also causes the first and second arms 15 and 16 to move inward. The strap 43 is operatively connected to each of the arms and the downward movement of the seat 43 causes the arm assemblies 15 and 16 to move inward. As the members 29 and 30 engage the person just below the rib cage, the protrusions 30*a* are contacting the person just below the rib cage. Further, as the members 29 and 30 contact the body, the members 29 and 30 tend to rotate along a longitudinal axis outwardly such that the protrusions 30 rotate further inward and upward and more securely engage the person under the rib cage. The members 29 and 30 are preferably covered with an upholstery or fabric which is a blend of polypropylene fiber so that heat build up is reduced and perspiration is wicked away from the person using the device. Natural covering materials (such as uncombed lambswool) are also contemplated.

The grommets 33–36 allow for upward rotation of the longitudinal protrustions. When the members 29 and 30 are in the correct position, the switches 41 and 41' are moved to a locked position and the locking devices 37 and 38 lock the arms 15 and 16 in a set position.

From the construction previously discussed, it is quite easy for the distance between the members 29 and 30 to be adjusted by rotating the connector 14. Similarly, the height of the device 10 can easily be adjusted by moving the pins 70 and 71 into a different hole 71 and 71'.

As described in the preferred embodiment, the arms 15 and 16 are pivotal. However, it is understood that other constructions may be utilized such as the arms being telescoping to allow for the members 29 and 30 to move between an engaged and an unengaged position. Still further, it has been found for best support and comfort, that the angle from the horizon formed between the grommet mounting holes for grommets 33–36 and the pivot point of the arms be from 30 to 60 degrees. This angle x is shown in FIG. 3. Still more preferably, the angle x is from 35 to 45 degrees.

The embodiment shown in FIG. 8 allows for the members 29 and 30 to be oriented at a variety of angles. In this embodiment, when the user is done using the device 10, it is simply a matter of removing the pins 70 and 71 and the arms 15 and 16 may then be rotated outward to allow the user to become disengaged from the members 29 and 30. The reverse procedure may then be used to enter into the device 10. By utilizing this arrangement, it is always possible to have the same position for the arms 15 and 16 as they are not adjusted each time the user gets into and out of the device 10. Further, this adjustment may be accomplished by having a set of mounting holes for each grommet 33–36. Then, depending on the set of holes utilized, the angle of the members 29 and 30 may be cooperatively adjusted. Each set of holes would be in a generally horizontal alignment and at approximately 1" intervals.

The present device is of a size that is very portable. The components of the device are easily disengaged and collapsed and adjustable to provide a traction device that a person may easily use in a variety of locations. The person may even position the device proximate a work area (such as a desk) and do productive work (normally done while standing or sitting) while at the same time reducing loading on the spine.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. A device for transferring stress from a lumbar spine to a rib cage of a person, the device comprising:

(a) a torso embracing member for at least partially surrounding the torso and for engaging and supporting a person proximate a person's waist below the rib cage, said member having a first section and a second section;

(b) a first pivot arm having first and second ends, said first end operatively connected to said first section;

(c) a second pivot arm having first and second ends, said first end operatively connected to said second section;

(d) a base support configured to pivotally mount said first and second pivot arms;

(e) a seat member operatively connected to said device wherein said pivot arms move between an unengaged position to an engaged position, wherein when in the unengaged position said first and second sections are spaced at a distance greater than when in the engaged position; and (f) means for locking said pivots arms in the engaged position wherein said pivot arms are fixed with respect to said base support, wherein said locking means comprises a first linear locking device having a piston rod for movement in a cylinder, said piston rod being continually adjustable to a locked, engaged position and wherein said torso embracing member supports the person when said pivots arms are in the engaged position and transfer stress from the lumbar spine to the rib cage.

2. A device for transferring stress from a lumbar spine to a rib cage of a person, the device comprising:

(a) a torso embracing member for at least partially surrounding the torso and for engaging and supporting a person below the rib cage, said member having a first section and a second section, said sections each having a generally horizontal longitudinal protrusion;

(b) a first movable arm having first and second ends, said first end operatively connected to said first section at a first location;

(c) a second movable arm having first and second ends, said first end operatively connected to said second section at a second location;

(d) a based support configured to moveably mount said first and second moveable arms;

(e) a seat member operatively connected to said device, wherein said moveable arms move between an unengaged position to an engaged position, wherein when in the unengaged position said first and second sections are spaced at a distance greater than when in the engaged position wherein said movable arms are fixed with respect to said base support;

(f) means for locking said arms in the engaged position; and (g) means for rotating said sections about a horizontal axis wherein said sections rotate to cause said protrusions to move further under the rib cage.

3. The device of claim 2, wherein said sections each have a generally arcuate shape and have top, bottom, front and rear portions and are flexible at said top and bottom portions to allow for support and comfort and flexible at said front and rear portions to allow for more comfortable breathing.

4. The device of claim 2, wherein said arms are pivotal and said first arm has a first pivot point proximate its second end and said second arm has a second pivot point proximate its second end.

5. The device of claim 2, wherein said sections are covered by polypropylene fiber, wherein heat build-up is reduced and perspiration is wicked away from the person using the device.

6. The device of claims 4, wherein when in the engaged position a line from said first location to said first pivot point forms an angle of from about 30 to 60 degrees from the horizontal.

7. The device of claim 6, wherein said angle is from about 35 to 45 degrees.

8. A device for transferring stress from a lumbar spine to a rib cage of a person, the device comprising:

(a) a torso embracing member for at least partially surrounding the torso and for engaging and supporting a person below the rib cage, said member having a first section and a second section;

(b) a first pivot arm having first and second ends, said first end operatively connected to said first section;

(c) a second pivot arm having first and second ends, said first end operatively connected to said second section;

(d) a base support configured to moveably mount said first and second pivot arms;

(e) a seat member operatively connected to said pivot arms, wherein the person sitting on the seat member assists in moving said pivot arms from the unengaged to an engaged position and said seat member is at a distance from said sections and said distance is adjustable; and (f) a first strap having a first end operatively connected to said first pivot arm and a second end operatively connected to said seat member and a second strap having a first end operatively connected to said second pivot arm and a second end operatively connected to said seat member.

9. The device of claim 8, wherein said sections are covered by a material having a polypropylene blend, wherein heat build up is reduced and perspiration is wicked away from the person using the device.

10. A device for transferring stress from a lumbar spine to a rib cage of a person, the device comprising:

(a) a torso embracing member for at least partially surrounding the torso and for engaging and supporting a person below the rib cage, said member having a first section and a second section;

(b) a first movable arm having first and second ends, said first end operatively connected to said first section;

(c) a second movable arm having first and second ends, said first end operatively connected to said second section;

(d) a base support configured to moveably mount said first and second moveable arms;

(e) a seat member operatively connected to said moveable arms, wherein the person sitting on the seat member assists in moving said movable arms from the unengaged to an engaged position; and (f) said first section and said second sections each having a back portion, wherein when in the engaged position, said back portions are substantially adjacent each other to form a back rest, wherein said back portions are positioned at an angle from the vertical of from 10 to 15 degrees.

11. A device for transferring stress from a lumbar spine to a rib cage of a person, the device comprising:

(a) a torso embracing member for at least partially surrounding the torso and for engaging and supporting a person below the rib cage, said member having a first section and a second section;

(b) a first movable arm having first and second ends, said first end operatively connected to said first section;

(c) a second movable arm having first and second ends, said first end operatively connected to said second section;

(d) a base support configured to moveably mount said first and second movable arms;

(e) a seat member operatively connected to said pivot arms, wherein the person sitting on the seat member assists in moving said pivot arms from the unengaged to an engaged position; and (f) a strap having a first end operatively connected to said first movable arm and a second end operatively connected to said second movable arm, said seat member operatively connected to said strap.

12. A device for transferring stress from a lumbar spine to a rib cage of a person, the device comprising:

(a) a torso embracing member for at least partially surrounding the torso and for engaging and supporting a person below the rib cage, said member having a first section and a second section;

(b) a first pivot arm having first and second ends, said first end operatively connected to said first section;

(c) a second pivot arm having first and second ends, said first end operatively connected to said second section;

(d) a base supporting configured to pivotally mount said first and second pivot arms;

(e) a seat member operatively connected to said device, wherein said pivot arms move between an unengaged position to an engaged position; and (f) means for locking said pivots arms in a fixed position, said locking means comprises a linear locking device having a piston rod for movement in a cylinder, said piston rod being continually adjustable to a locked, engaged position.

* * * * *